US007568310B2

(12) United States Patent
Sato et al.

(10) Patent No.: US 7,568,310 B2
(45) Date of Patent: Aug. 4, 2009

(54) OPENING/CLOSING SYSTEM FOR VEHICLE

(75) Inventors: Masaei Sato, Kiryu (JP); Toru Takahashi, Kiryu (JP); Yoshitaka Sekine, Kiryu (JP); Kousi Miura, Kiryu (JP)

(73) Assignee: Mitsuba Corporation, Kiryu-shi, Gunma (JP)

( * ) Notice: Subject to any disclaimer, the term of this patent is extended or adjusted under 35 U.S.C. 154(b) by 649 days.

(21) Appl. No.: 10/937,081

(22) Filed: Sep. 9, 2004

(65) Prior Publication Data

US 2005/0055883 A1 Mar. 17, 2005

(30) Foreign Application Priority Data

Sep. 11, 2003 (JP) ..... 2003-319991

(51) Int. Cl.
*E05F 11/00* (2006.01)

(52) U.S. Cl. ..... 49/360

(58) Field of Classification Search ..... 49/360; 296/155

See application file for complete search history.

(56) References Cited

U.S. PATENT DOCUMENTS 6,270,149 B1 * 8/2001 Fukumoto et al. ..... 296/155
6,408,573 B1 6/2002 Fukumoto et al.

FOREIGN PATENT DOCUMENTS

DE 38 29 405 C2 3/1990
DE 42 09 652 C1 4/1993
JP 2000177391 A 6/2000
JP 2000179233 A 6/2000
JP 2002327576 A 11/2002
JP 2003074255 A 3/2003

OTHER PUBLICATIONS

German Office Action for Serial No. 10 2004 043 704.1-23 dated Jan. 22, 2008 and English translation.

* cited by examiner

*Primary Examiner*—Jerry Redman
(74) *Attorney, Agent, or Firm*—Kir

(57) ABSTRACT

An opening/closing system for vehicle can improve detection accuracy of rotation of an output member and enhance reliability of its operation. The opening/closing system for vehicle includes a drive unit having an electric motor and a reduction gear unit. A drum, which is an output member, is fixed to the output shaft of the drive unit through a power transmittable member. A magnet fixed to the outer periphery of a disk member is disposed between the drum and the gear case of the reduction gear unit in such a way that the magnet rotates along with the drum when the disk member is fixed to the power transmittable member. A housing case fixed to the gear case is provided with a sensor accommodating section that accommodates a magnetic sensor. The magnetic sensor is disposed to detect the rotation of the drum from a change in a magnetic field created by the magnet.

17 Claims, 9 Drawing Sheets

OPENING/CLOSING SYSTEM FOR VEHICLE

Applicants hereby claim forein priority benefits under U.S.C. § 119 from Japanese Patent Application No. 2003-319991, filed on Sep. 11, 2003, the content of which is incorporated by reference herein.

BACKGROUND OF THE INVENTION

The present invention relates to an opening/closing system for a vehicle, which automatically opens and closes an opening/closing member provided to the vehicle and particularly to a technique effectively applied to the opening and closing of a sliding door, and a back door, etc.

An opening/closing member such as a door, a backdoor, and a sunroof is provided everywhere to a vehicle such as an automobile. Particularly, as is often the case with a station wagon and a one-box car (minivan) etc., a side portion of the vehicle is provided with the sliding door that is opened and closed in vehicle-front and vehicle-rear directions, whereby, through the side portion, for example, some people can easily get in or out and a load can be easily put in the vehicle or removed from it.

Since an open space at the side portion of the vehicle, which is required at the time of opening and closing such a sliding door, can be made small, it is often applied to a comparatively large opening. For this reason, there is a trend toward the fact that the sliding door itself is enlarged, and there is the case where it is difficult for women and/or children to open and close freely the sliding door due to increase of weight of the sliding door. Particularly, there is the problem that it is impossible to open easily the sliding door on a sloping road due to its own weight. Consequently, under the current circumstances where use of family cars such as one-box cars is increasing, there has been developed a vehicle mounted on an opening/closing system for vehicle, which automatically opens and closes the sliding door so as to be easily opened and closed even by the women and children.

As such an opening/closing system, there is well known the system in which cables connected to the sliding door from vehicle-front and vehicle-rear sides are wound around a drum and the sliding door is opened and closed by rotation-driving the drum using a drive unit. In this case, the drive unit has an electric motor serving as a drive source and a reduction gear mechanism accommodated in a gear case, wherein the rotation of the electric motor is reduced to a predetermined revolution speed by the reduction gear mechanism and then output through an output shaft. The output shaft is provided to project from the gear case and the above-mentioned drum is fixed to the output shaft and rotation-driven by the drive unit. Due to this, when the electric motor is operated, either cable on the vehicle-front or vehicle-rear side is taken up by the drum and the sliding door is opened and closed while being drawn by the cable. At this time, a moving direction of the sliding door is determined by a rotation direction of the electric motor.

Even in the vehicle provided with such an opening/closing system, the sliding door of the vehicle is opened and closed manually in some cases. However, since the sliding door is linked to the electric motor through the cables, drum, and reduction gear mechanism, etc., the power required for handling such a sliding door is much greater than that for handling a sliding door having no opening/closing member. Accordingly, there has been known a structure in which an electromagnetic clutch is provided between a reduction gear mechanism and an output shaft so as to make intermittently a power transmission therebetween and the electromagnetic clutch becomes broken when the sliding door is manually opened and closed. With this arrangement, when the sliding door is manually opened and closed, the power transmission between the electric motor and the sliding door is broken by the electromagnetic clutch. Thus, a control force for handling the sliding door becomes as small as that for handling a sliding door having no opening/closing member, so that a sense of control of the sliding door is improved. As the above-mentioned electromagnetic clutch, there is used a so-called friction type one comprising a drive disk fixed to a side of the reduction gear mechanism, a follower disk fixed to an output shaft, and a clutch coil, wherein the mutually faced disks are pressed by magnetic attraction caused by the clutch coil and the transmission of power is made. Therefore, the electromagnetic clutch is accommodated in the gear case and formed integrally with the drive unit.

For example, in Japanese Patent laid-open No. 2000-179233 and No. 2003-74255, there has been well known an opening/closing system comprising a sensor magnet fixed to an outer periphery of a rotor in an electromagnetic clutch, and a magnetic sensor such as a Hall device fixed into a gear case so as to oppose to the sensor magnet, wherein the operation of the opening/closing system is controlled according to a detection signal outputted from the magnetic sensor. In this case, the magnetic sensor is adapted to output a pulse signal having a period that depends on the revolution speed of the sensor magnet, namely, a drum. The opened and closed positions of the sliding door are detected by integrating the pulse signal from the time when the sliding door is completely closed, and the setting of moving speed and the control of a slow stop mode and so on are made in accordance with the opened and closed positions. Additionally, extension of the period that the pulse signal has is detected and when the extension is equal to or exceeds a predetermined value, insertion is detected. Therefore, the insertion is prevented by stopping movement of the slide door or reversing it.

SUMMARY OF THE INVENTION

However, in such an opening/closing system, since the sensor magnet is fixed to a periphery of the rotor of the electromagnetic clutch, a magnetic field of the sensor magnet is disturbed due to the magnetic field generated by the clutch coil in some cases. Additionally, since the electromagnetic clutch has a structure in which the disks thereof are frictionally engaged with each other, there is the fear that magnetized abrasion powders are produced in the gear case and such magnetized abrasion powders adhere to the sensor magnet. In these cases, since the accuracy of detection of the magnetic sensor is reduced, there is the fear that the reliability of the controlling operation of the sliding door, which is conducted according to the detection signal of the magnetic sensor, is reduced.

Furthermore, since the magnetic sensor is housed in the gear case along with the sensor magnet, there is the fear that detection sensitivity of the magnetic sensor is degraded and the detection accuracy of the revolution sensor is reduced when the temperature of the inside of the gear case rises due to heat etc. generated by the electric motor.

Therefore, an object of the present invention is to improve the detection accuracy of revolutions of the output member and enhance the reliability of operation of an opening/closing system for vehicle.

An opening/closing system for vehicle according to the present invention, which automatically opens and closes an opening/closing member provided to the vehicle, comprises: a drive unit having a drive source and a reduction gear mechanism accommodated in a gear case, an output shaft for outputting a rotation of said drive source projecting from said gear case; an output member fixed to said output shaft and linked to said opening/closing member, and outputting power of said drive unit to said opening/closing member; a magnet disposed between said gear case and said output member, and rotating along with said output member; and a magnetic sensor disposed so as to oppose said magnet and detecting a rotation of said output member from a change in a magnetic field created by said magnet.

In the opening/closing system for vehicle according to the present invention, said magnet is fixed to an outer periphery of a disk member rotating along with said output member.

In the opening/closing system for vehicle according to the present invention, said output member is fixed to said output shaft through a power transmittable member and said disk member is fixed to said power transmittable member.

The opening/closing system for vehicle according to the present invention further comprises: a case body provided with an output member accommodating section, which covers the radial outer periphery of said output member, and fixed to said gear case; and a cover fixed to said case body and closing said output member accommodating section.

In the opening/closing system for vehicle according to the present invention, said case body is provided with a partition wall extending between said gear case and said output member.

In the opening/closing system for vehicle according to the present invention, said partition wall extends between said output member and said disk member.

In the opening/closing system for vehicle according to the present invention, said partition wall forms a labyrinth seal along with said output member.

In the opening/closing system for vehicle according to the present invention, said partition wall forms a labyrinth seal along with said disk member.

In the opening/closing system for vehicle according to the present invention, said output shaft is disposed horizontally to said vehicle, and said output member accommodating section is provided with a sloped surface located below said output member and extending to a drainage hole.

In the opening/closing system for vehicle according to the present invention, said case body is provided with a sensor accommodating section for accommodating said magnetic sensor, and said magnetic sensor is held by said case body in said sensor accommodating section.

In the opening/closing system for vehicle according to the present invention, said sensor accommodating section is closed by a falling-off section provided to said cover.

According to the present invention, since the magnet that rotates along with the output member is disposed between the gear case of the drive unit and the output member, the magnetic field created by the magnet is prevented from being disturbed, so that the detection accuracy of the rotation of the output member can be improved by the magnetic sensors. Additionally, since the magnet is disposed on the side of the gear case with respect to the output member, the influence on the vibration of the output shaft is blocked and so the detection of the rotation of the output member can be improved by the magnetic sensors. As a result, it is possible to improve the reliability of operation of the opening/closing system for the vehicle.

Additionally, according to the present invention, since the magnet is fixed to the outer peripheral end of the disk member, it is possible to block the noise generated due to the reduction gear mechanism by the disk member and therefore to reduce the noise in the cabin of the vehicle.

Still additionally, according to the present invention, since the disk member to which the magnet is fixed is fixed to the power transmittable member that is fixed to the output shaft, it can be positioned easily.

Still additionally, according to the present invention, since the gear case is blocked from the output member by a partition wall, it is possible to improve the waterproof effect on the opening/closing system for the vehicle. Furthermore, since the noise generated by the reduction gear mechanism is blocked by the partition wall, it is possible to reduce the noise level in the cabin of the vehicle.

Still additionally, according to the present invention, since the partition wall forms a labyrinth seal along with the output member or the disk member, it is possible to improve the waterproof effect on the opening/closing system for the vehicle.

Still additionally, according to the present invention, since any water or rain water etc. entering the interior of the output member accommodating section is made to flow down along a sloped surface and drain through a drainage hole, it is possible to improve the waterproof effect on the case body and the opening/closing system for the vehicle.

Still additionally, according to the present invention, since the magnetic sensors are held at the case body and positioned in the sensor accommodating section that is provided to the case body, it is possible to position the magnetic sensors with respect to the magnet easily.

Furthermore, according to the present invention, since the sensor accommodating section that accommodates the magnet sensor is closed by a falling-off section provided on the cover for closing the output member accommodating section and the magnetic sensors are prevented from slipping out of the sensor accommodating section by the falling-off section, it is possible to easily carry out attachment of the magnetic sensors.

DESCRIPTION OF THE PREFERRED EMBODIMENT

Hereinafter, an embodiment of the present invention will be detailed based on the drawings.

Figure 1:
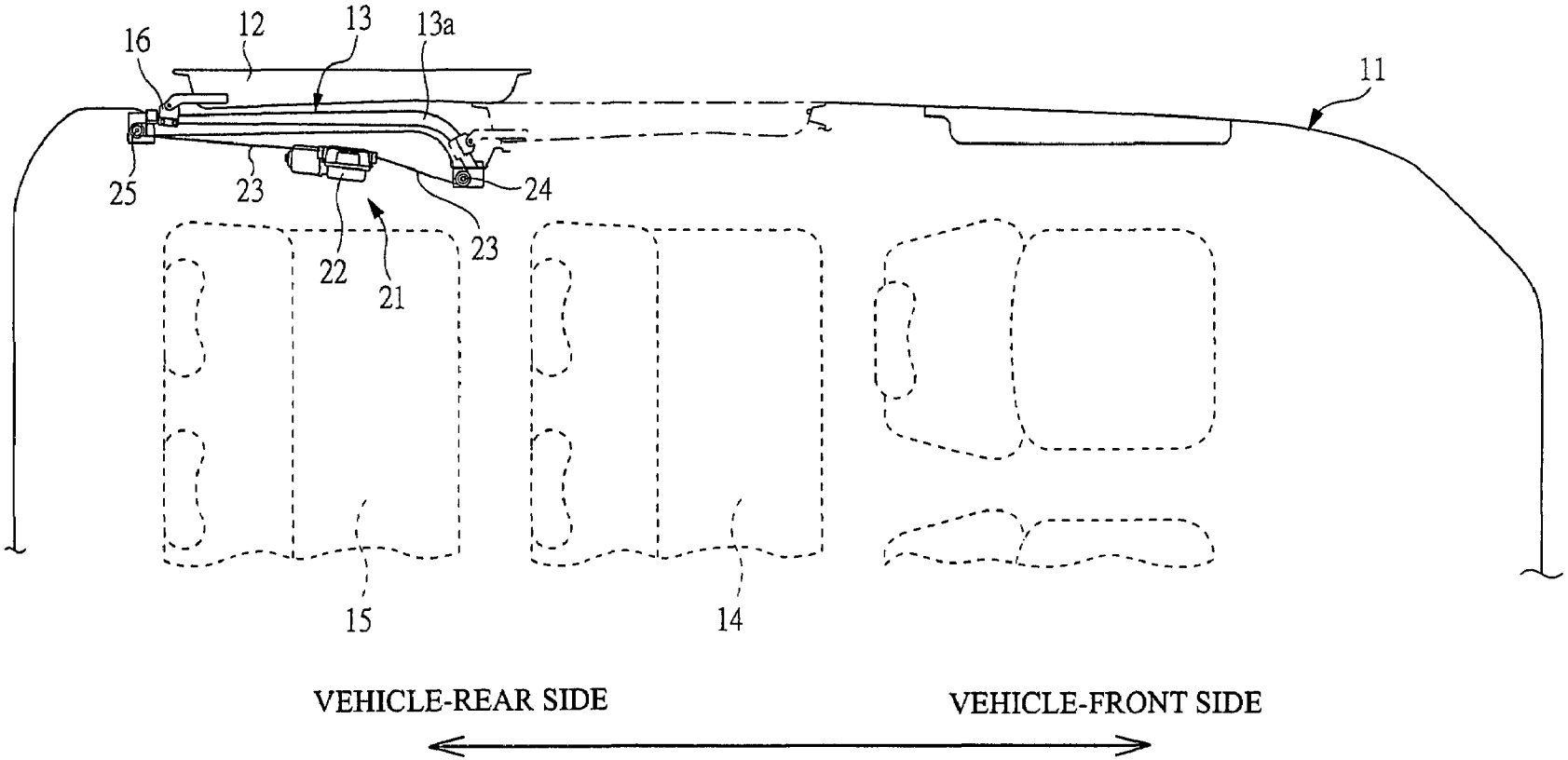
FIG. 1 is an explanatory view for describing a vehicle equipped with an opening/closing system for vehicle according to an embodiment of the present invention.
Figure 2:
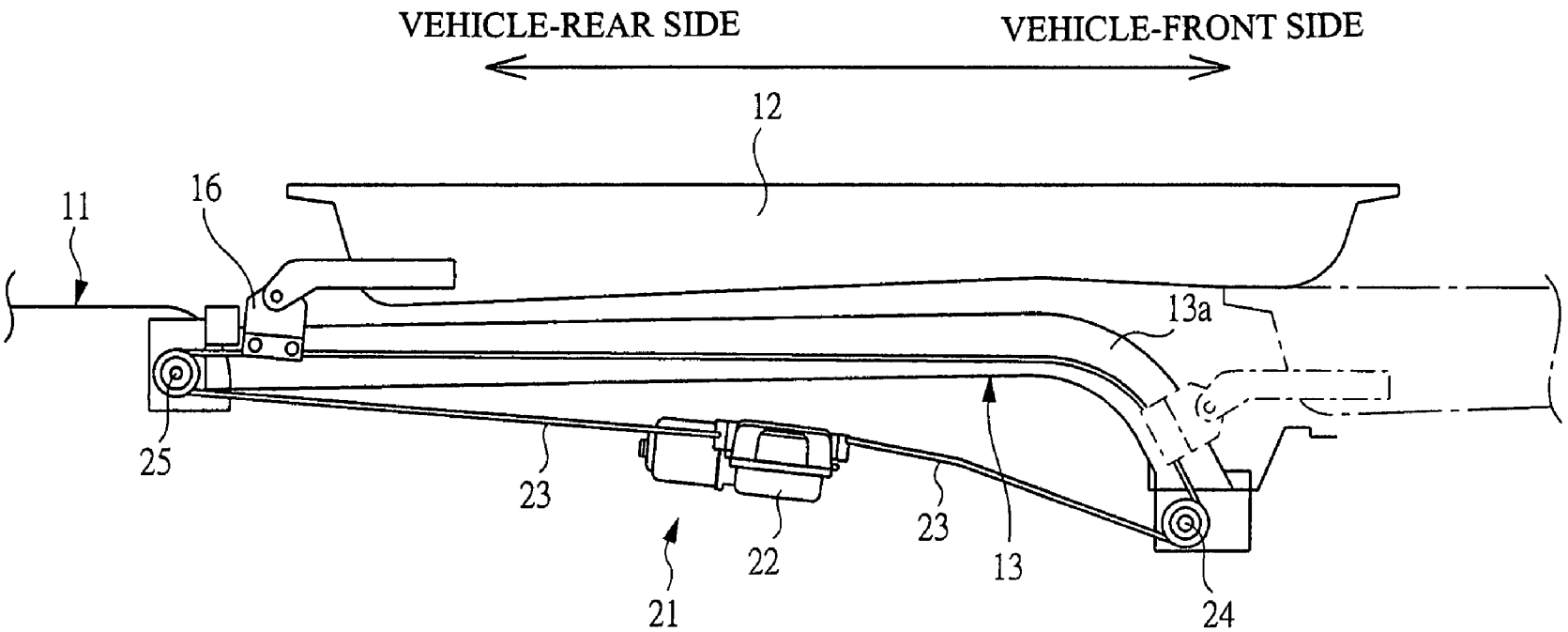
FIG. 2 is an enlarged plan view of a principal portion of the vehicle shown in FIG. 1.

FIG. 1 is an explanatory view for describing a vehicle equipped with an opening/closing system for vehicle according to an embodiment of the present invention. FIG. 2 is an enlarged plan view of a principal portion of the vehicle shown in FIG. 1.

As shown in FIG. 1, a side portion of a vehicle 11 is provided with a sliding door 12 that is an opening/closing member. The sliding door 12 is guided by a guide rail 13 fixed to the vehicle 11 and can be opened and closed between a fully opened position indicated by the solid lines in FIG. 1 and a fully closed position indicated by the dotted chain lines thereof, and therefore is used by being opened up to the fully opened position when passengers get on and off a second seat 14 or a third seat 15 provided in a vehicle interior or cargos are loaded therein and discharged therefrom.

As shown in FIG. 2, a roller assembly 16 is attached to the sliding door 12, so that the sliding door 12 can be moved in vehicle-front and vehicle-rear directions since the roller assembly 16 is guided by the guide rail 13. Also, the guide rail 13 on a vehicle-front side is provided with a curved section 13*a* that is curved toward the inside of the vehicle. Since the roller assembly 16 is guided by the curved section 13*a,* the sliding door 12 is drawn inside the vehicle 11 so that an outer surface of the sliding door 12 can fall within the same surface as a side surface of the vehicle 11, whereby the sliding door is closed.

The vehicle 11 is provided with an opening/closing system for vehicle 21 for automatically opening and closing the sliding door 12 (hereinafter abbreviated as an "opening/closing system 21"). The opening/closing system 21 comprises: an actuator unit 22 arranged to be adjacent to the guide rail 13 at a substantially central portion of the guide rail 13 with respect to the vehicle-front and vehicle-rear sides and fixed to the vehicle 11; and two cables 23 for linking the actuator unit 22 and the sliding door 12. These cables 23 are connected to the sliding door 12 via the roller assembly 16 from each of the vehicle-front and vehicle-rear sides. End portions of the guide rail 13 on the vehicle-front and vehicle-rear sides are provided with reverse pulleys 24 and 25, so that the cables 23 are guided by the actuator unit 22 via the reverse pulleys 24 and 25. Therefore, by pulling one of the cables 23 using the actuator unit 22, the sliding door 12 is can be opened and closed.

Figure 3:
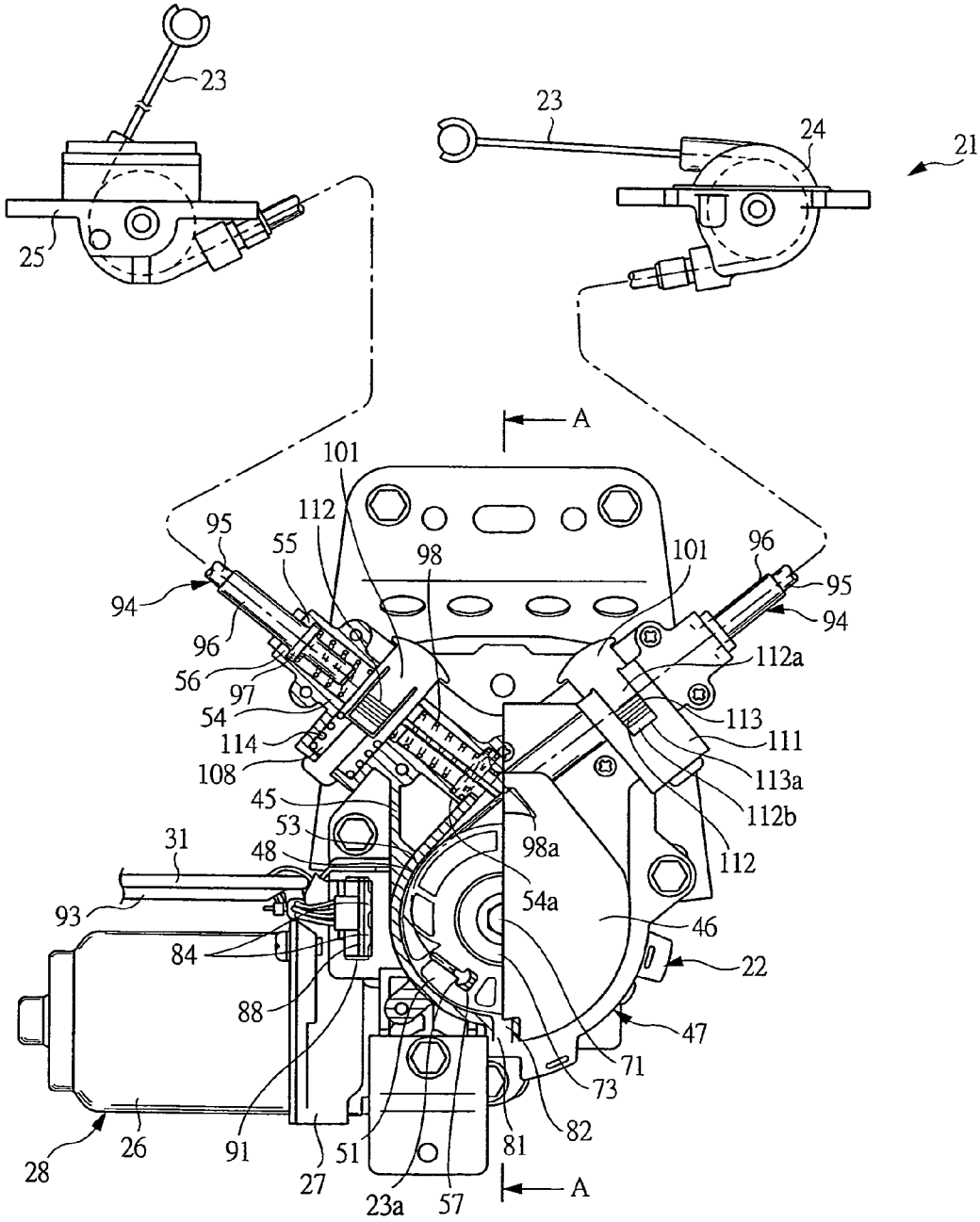
FIG. 3 is a partially notched sectional view showing the details of the opening/closing system for vehicle shown in FIG. 2.
Figure 4:
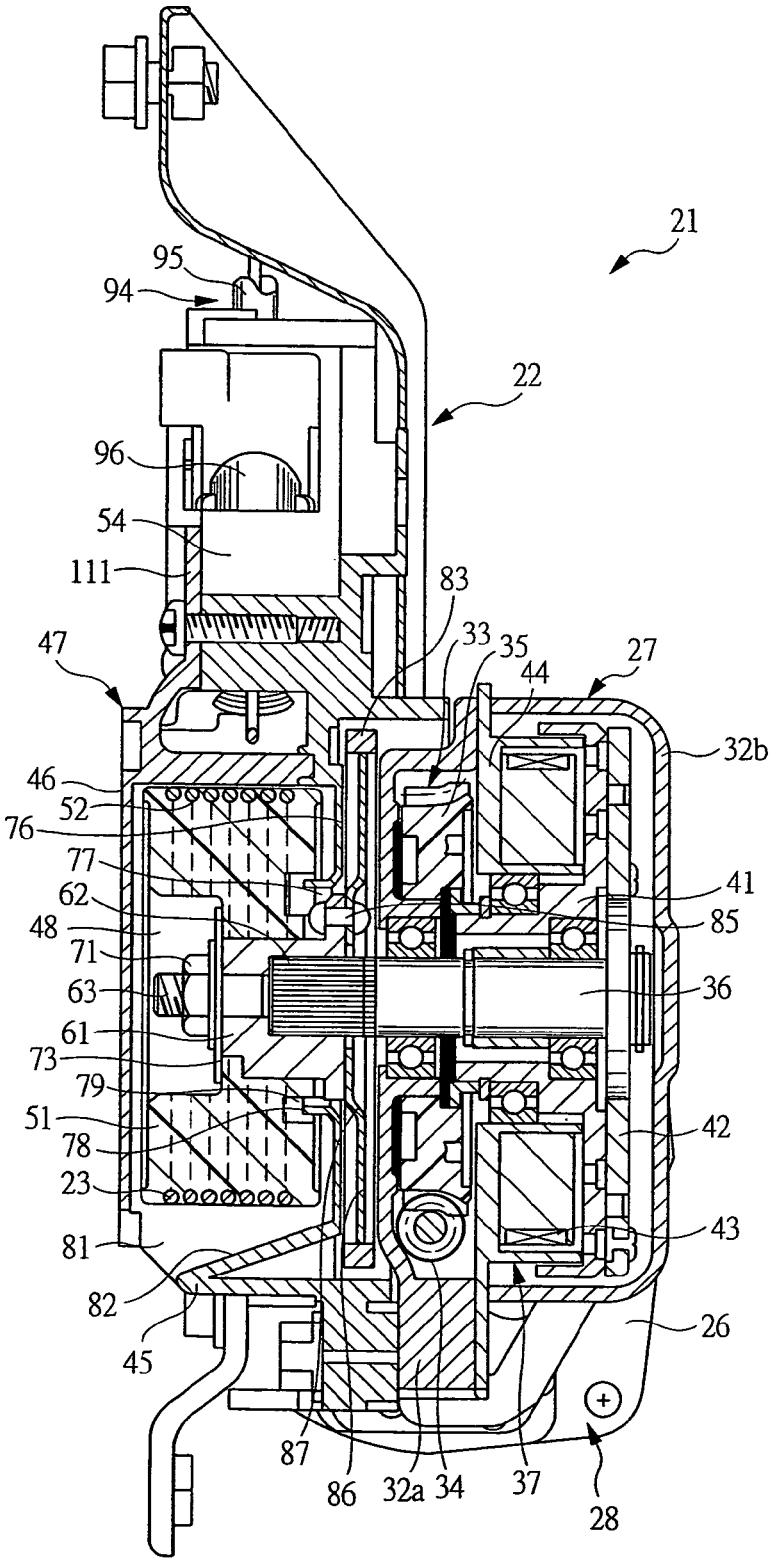
FIG. 4 is a sectional view taken along the line A-A shown in FIG. 3.

FIG. 3 is a partially notched sectional view showing the details of the opening/closing system for vehicle shown in FIG. 2, and FIG. 4 is a sectional view taken along the line A-A shown in FIG. 3. Additionally, FIG. 5 is an exploded perspective view of the opening/closing system for vehicle shown in FIG. 3.

Figure 5:
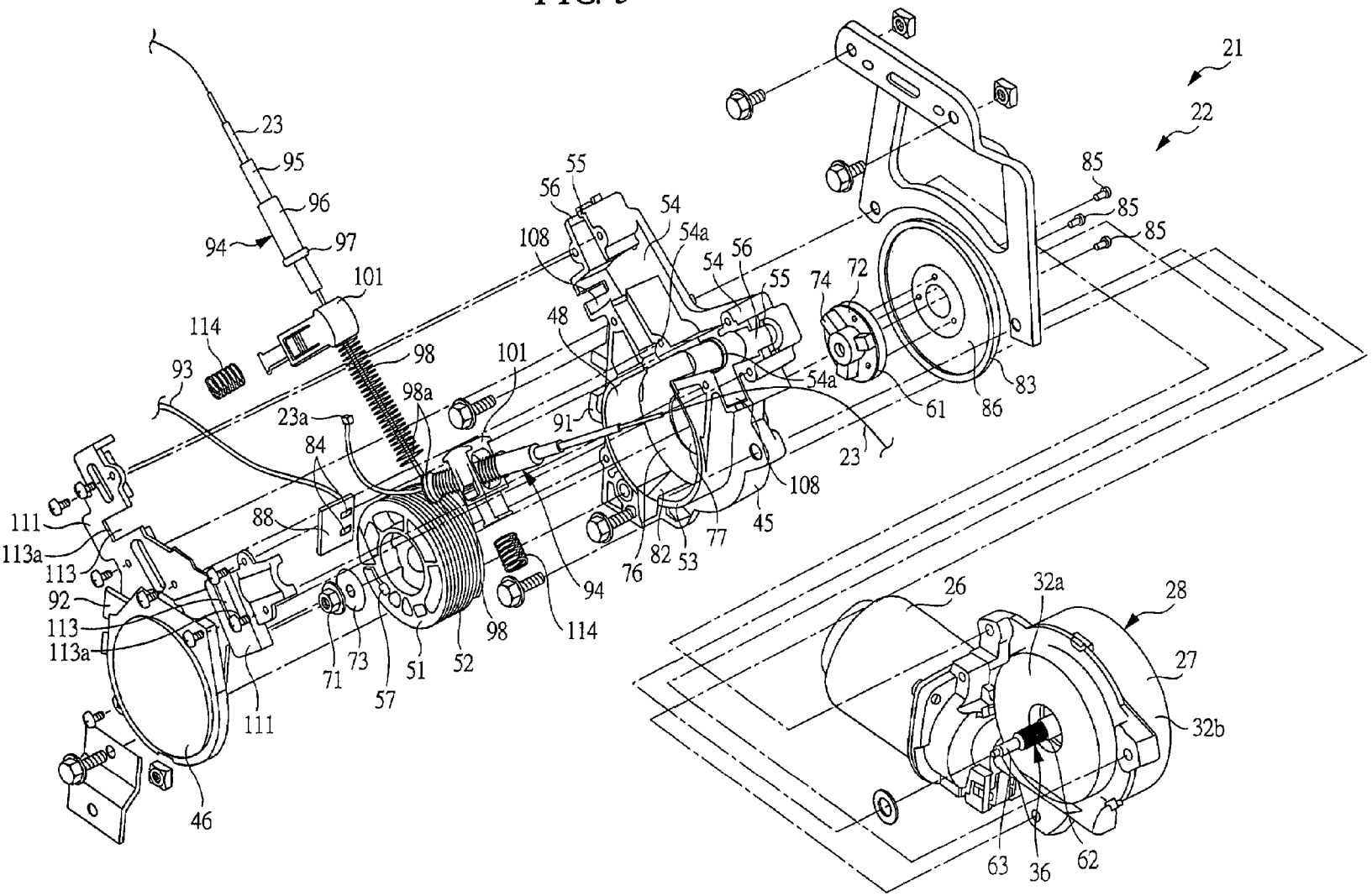
FIG. 5 is an exploded perspective view of the opening/closing system for vehicle shown in FIG. 3.

As shown in FIGS. 3 to 5, the opening/closing system 21 comprises a drive unit 28 including an electric motor 26 serving as a drive source and a reduction gear unit 27 fixed to the electric motor 26. A drive force required for opening and closing the sliding door 12 is generated by the drive unit 28 used as a drive means. The electric motor 26 is connected to a control unit (not shown) via a feeder line 31, thereby being operated and controlled by the control unit. A microcomputer provided with a CPU, and a memory, etc. is used as the control unit. The control unit is adapted to supply a DC current flowing in a predetermined direction to the electric motor 26 in accordance with a command signal sent from a sliding door opening/closing switch (not shown) and to operate the electric motor 26 forwardly or reversely.

Meanwhile, as shown in FIG. 4, the reduction gear unit 27 has a structure in which a reduction gear mechanism 33 is accommodated inside a gear case 32*a* fixed to the electric motor 26. In the case of its illustration, there is used, as the reduction gear mechanism 33, a worm gear mechanism including: a worm 34 formed on an outer periphery of a rotary shaft of the electric motor 26; and a worm wheel 35 rotatably accommodated inside the gear case 32*a.* An output shaft 36 of the drive unit 28 projects form the gear case 32*a,* so that the rotation of the electric motor 26 is reduced to predetermined rotation via the reduction gear mechanism 33 and outputted from the output shaft 36.

Note that although the worm gear mechanism is used as the reduction gear mechanism 33 when is illustrated, the present invention is not limited thereto and may use a reduction gear mechanism of other type such as combination of spur gear wheels different in the number of teeth.

An electromagnetic clutch 37 is provided on the gear case 32*a* so that power transmission between the reduction gear mechanism 33 and the output shaft 36 can intermit by the electromagnetic clutch 37. The electromagnetic clutch 37 is a so-called friction type electromagnetic clutch and includes a drive disk 41, a follower disk 42 and a clutch coil 43. The drive disk 41 is disk-shaped and made of steel, and is linked to the worm wheel 35 so as to rotate integrally with the worm wheel 35. The follower disk 42 is disk-shaped and made of steel, and is spline-engaged with the output shaft 36 so as to rotate integrally with the output shaft 36 and simultaneously to be axially movable with respect to the output shaft 36. The clutch coil 43 is accommodated in a coil holder 44 fixed to the gear case 32*a* and is disposed at a back portion of the drive disk 41, that is, on a side opposite to a friction surface coming in contact with the follower disk 42, thereby creating a magnetic force by electric power supplied from the control unit (not shown). Note that a clutch cover 32*b* is attached to the gear case 32*a* so as to cover the electromagnetic clutch 37. When the magnetic force is created by the clutch coil 43, the follower disk 42 is moved to approach the drive disk 41, so that the respective disks 41 and 42 are pressed against each other on their friction surfaces. As a result, a relation between the worm wheel 35 and the output shaft 36 becomes in a power transmissible state of being fixed to each other through the disks 41 and 42, so that the rotation of the worm wheel 35, namely, that of the electric motor 26 is transmitted to the output shaft 36. Further, if the supply of power to the clutch coil 43 is stopped, the frictional force between the disks 41 and 42 is reduced and a relation between the worm wheel 35 and the output shaft 36 becomes in a power cutoff state. Thus, the power transmissible state between the electric motor 26 and the output shaft 36 intermits by the electromagnetic clutch 37.

There is fixed, to the drive unit 28, a housing case 47 including: a case body 45 fixed to the gear case 32*a;* and a cover 46 fixed to the case body 45, wherein an output member 51 is accommodated inside an output member accommodating section 48 provided to the case body 45. In this case, the output member 51 is a resin drum 51, on an outer surface of which two helical cable guide grooves 52 are formed, thereby being rotatable inside the output member accommodating section 48.

The output member accommodating section 48 has a cylindrical section 53 having an inner diameter slightly greater than the outer diameter of the drum 51 and opposed to the outer peripheral surface of the drum 51, whereby the outer periphery of the drum 51 is radically covered by the cylindrical section 53. Further, the cover 46 is adapted to close an open end of the output member accommodating section 48, so that the drum 51 is isolated from the outside by the cylindrical section 53 and the cover 46.

The case body 45 is provided with two guide sections 54 arranged to be of a substantially V-shape with respect to the output member accommodating section 48. A portion of each cable 23 is inserted into the interior of the case body 45 from a cable insertion hole 56, which is provided to an end surface 55 of each corresponding guide section 54, and therefore is guided by the drum 51. In other words, a part of the cable 23 located at a side of the drum 51 is movably accommodated inside the hosing case 47. Each of the cables 23 is attached to a cable fixing groove 57 obtained by forming a drum-like part 23*a* provided to the end portion thereof on an end surface of the drum 51 and is wound around a corresponding cable guide grove 52 by two or more turns opposite to each other. In short, the drum 51 is linked to the sliding door 12 through the cables 23 and the drive force of the drive unit 28 is transmitted to the sliding door 12 by the cables 23 provided between the drive unit 28 and the sliding door 12.

At this time, a gap between the outer peripheral surface of the drum 51 and the cylindrical section 53 is smaller than the outer diameter of the cables 23, so that even if the cables 23 become loose with respect to the drum 51, the cables 23 do not come away from the cable guide grooves 52. Additionally, since the case body 45 is fixed to the drive unit 28 and the drum 51 is fixed to the output shaft 36 of the drive unit 28, it is easy to position the outer peripheral surface of the drum 51 and the inner surface of the cylindrical section 53 to have a fixed gap therebetween smaller than an outer diameter of the cable 23.

Thus, in the opening/closing system 21, the output member accommodating section 48 is provided to the case body 45 fixed to the gear case 32*a* and the output member accommodating section 48 is closed by the cover 46 fixed to the case body 45, so that it is easy to position the drum 51 accommodated in the output member accommodating section 48 and the output member accommodating section 48. Therefore, it is possible to set the between the outer peripheral surface of the drum 51 and the inner surface of the output member accommodating section 48 to a fixed narrow interval and prevent the cables 23 from coming away from the cable guide grooves 52. Additionally, the cables 23 are prevented from coming away from the cable guide grooves 52 even when the drum 51 around which the cables 23 are wound is attached to the output member accommodating section 48. Therefore, the operation of assembling the opening/closing system 21 can be carried out easily.

Figure 6:
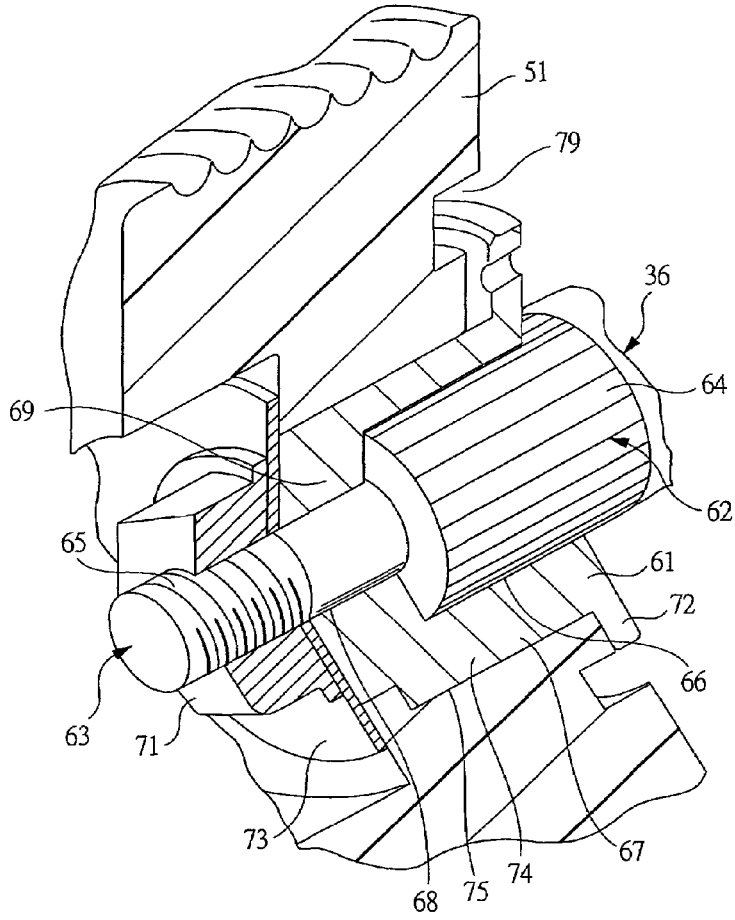
FIG. 6 is a sectional view showing the details of a fixed portion of a drum and an output shaft.

FIG. 6 is a sectional view showing the details of a fixed portion of a drum and an output shaft. As shown in FIG. 6, a power transmittable member 61 is provided between the drum 51 and the output shaft 36 and the drum 51 is fixed to the output shaft 36 through the power transmittable member 61.

A portion of the output shaft 36 projecting from the gear case 32*a* has a main shaft section 62 whose diameter is substantially the same as the diameter of the interior of the gear case 32*a*. A small diameter shaft section 63 smaller in diameter than the main shaft section 62 projects from a front end of the main shaft section 62. Further, a serration section 64 serving as an engaging section is formed on an outer peripheral surface of the main shaft section 62, and a male screw section 65 serving as a fastening section is formed at a front end of the small diameter shaft section 63.

Meanwhile, the power transmittable member 61 has: an annular anti-rotation section 67 provided with an engaging hole 66, on a inner surface of which a serration groove is formed so as to correspond to the main shaft section 62; and an annular positioning section 69 provided with such a smaller diameter hole 68 as to correspond to the small diameter shaft section 63. The power transmittable member 61 has a structure in which the above-mentioned sections are made of steel and formed integrally with each other. The engaging hole 66 is engaged with the serration section 64 by inserting the main shaft section 62. The small diameter shaft section 63 is adapted to be inserted into the small diameter hole 68. Further, a nut 71 serving as a fastening member is screw-connected to the male screw section 65. The positioning section 69 is sandwiched between the nut 71 and the front end portion of the main shaft section 62. Note that the nut 71 is a so-called anti-loosening nut having an anti-loosening function.

That is, the power transmittable member 61 is prevented from turning with respect to the main shaft section 62 when the anti-rotation section 67 is engaged with the serration section 64 at the engaging hole 66, and further the axial positioning is carried out when the positioning section 69 is fastened to the nut 71 with the front end portion of the main shaft section 62. As a result, the power transmittable member 61 is fixed to the output shaft 36, thereby rotating integrally with the output shaft 36.

Thus, in the opening/closing system 21, the positioning is carried out with respect to the output shaft 36 when the positioning section 69 of the power transmittable member 61 is inserted between the front end portion of the main shaft section 62 and the nut 71. Therefore, the main shaft section 62 provided with the serration section 64 for preventing the power transmittable member 61 from rotating can be formed so as to have substantially the same diameter as that of the interior of the gear case 32*a*. Accordingly, it is unnecessary to use a highly strong and expensive material for forming the output shaft 36 and so the cost of the opening/closing system 21 can be reduced.

There is provided, to an axial end portion on a side opposite to the gear case 32*a* of the power transmittable member 61, an annular engaging section 72 radially projecting from the outer periphery of the anti-rotation section 67. A washer 73 serving as a large diameter greater than that of the positioning section 69 is provided between the nut 71 and the power transmittable member 61. Therefore, the drum 51 is sandwiched between the engaging section 72 and the washer 73 and fixed to the power transmittable member 61. At this time, since the end surface of the drum 51 disposed on a side opposite to the washer 73 is on substantially the same surface as the end surface of the power transmittable member 61 disposed on a side opposite to the washer 73, the fastening force of the nut 71 is mainly supported by the power transmittable member 61 made of steel. Therefore, the large fastening force is not applied to the drum 51 made of a resin. Note that although the large diameter section is the washer 73 formed separately from the nut 71 when is illustrated, the present invention is not limited thereto and, for example, may use, instead of the large diameter section, a flange for the nut 71, which is formed integrally with the nut 71.

As described above, in the opening/closing system 21, the drum 51 is fixed to be sandwiched between the engaging section 72 provided to the power transmittable member 61 and the washer 73. Therefore, the fastening force of the nut 71 is mainly applied to the power transmittable member 61, whereby it is possible to prevent the drum 51 from being deformed by the fastening force of the nut 71.

Three convex portions 74 are provided so as to project radially from the outer periphery of the power transmittable member 61. The drum 51 is prevented from rotating with respect to the power transmittable member 61 when the convex portions 74 are engaged with concave portions 75 formed on the drum 51.

With the above-described arrangement, the drum 51 is fixed to the output shaft 36 via the power transmittable member 61 and is rotate-driven by the drive unit 28. When the drum 51 is rotate-driven by the drive unit 28, one of the cables 23 is taken up by the drum 51 and the other of the cables 23 is feed out from the drum 51 to open and close the sliding door 12. Additionally, when the rotation direction of the electric motor 26, namely, that of the drum 51 is reversed, the moving direction of the sliding door 12 can be changed. Thus, the power of the drive unit 28 is outputted to the sliding door 12 by the drum 51 so as to drive the sliding door 12.

In such an opening/closing system 21, since a portion of the cable 23 is exposed to the outside of the vehicle 11, rain water and dust, etc. enter into the interior of the output member accommodating section 48 via the cables 23 and adhere to the electric motor 26 and the reduction gear unit 27. For this reason, there is the fear of interfering with the operation of the drive unit 28. Therefore, in the opening/closing system 21, since a partition wall 76 extending between the drum 51 and the gear case 32*a* is provided to the case body 45, the partition wall 76 prevents rain water and dust, etc. entering into the interior of the output member accommodating section 48 from adhering the drive unit 28.

The partition wall 76 is formed of a disk shape and extends radially and inwardly from an end portion of the cylindrical section 53 located on a side of the gear case 32*a* toward the output shaft 36. It is provided at the axial center thereof with a through hole 77 through which the output shaft 36 and the power transmittable member 61 pass. Additionally, the partition wall 76 is provided at the inner peripheral end thereof with a seal section 78 that is bent toward the drum 51. The seal section 78 is located inside an annular groove 79 formed on the end surface of the drum 51. In other words, since the seal section 78 of the partition wall 76 has a labyrinth seal formed along with the annular groove 79 of the drum 51, it is possible to enhance waterproof effect on rain water etc. flowing from the output member accommodating section 48 toward the gear case 32*a*.

As described above, in the opening/closing system 21, since the partition wall 76 is provided between the gear case 32*a* and the drum 51, foreign matters such as rain water and dust entering the output member accommodating section 48 can be prevented from adhering to the drive unit 28. Additionally, the partition wall 76 blocks noise generated by the gear case 32*a* to reduce the noise level in the cabin of the vehicle 11 to which the opening/closing system 21 is provided.

Further, in the opening/closing system 21, since the partition wall 76 forms a labyrinth seal along with the drum 51, it is possible to enhance the waterproof effect on foreign matters such as rain water etc. leaking from the output member accommodating section 48 toward the side of the gear case 32*a*.

Additionally, in this case, since the actuator unit 22 is fixed to the vehicle 11 in such a way that the output shaft 36 of the reduction gear unit 27 is held horizontal with respect to the vehicle 11, the foreign matters entering the output member accommodating section 48 are accumulated in a lower portions of the drum 51. Therefore, in the opening/closing system 21, since a sloped surface 82 located in the lower portion of the drum 51 and extending to a drainage hole 81 is provided to the output member accommodating section 48, it is possible to drain rain water etc. from the drainage hole 81 via the sloped surface 82. Due to this, the drainage effect of the output member accommodating section 48 is improved and the waterproof effect of the opening/closing system 21 can be enhanced.

Thus, in the opening/closing system 21, since the output member accommodating section 48 is provided with the sloped surface 82 extending to the drainage hole 81, the drainage effect of the output member accommodating section 48 is improved and the waterproof effect of the opening/closing system 21 can be enhanced.

The opening/closing system 21 is provided with: a magnet 83 disposed between the drum 51 and the gear case 32*a* and rotating along with the drum 51; and two magnetic sensors 84 arranged to oppose the magnet 83 and detecting the rotation of the drum 51 depending on a change in the magnetic field created by the magnet 83, wherein the above-mentioned control unit controls the operation of the electric motor 26 based on the detection signals from the magnetic sensors 84.

The magnet 83 is formed of an annular shape and operates as a so-called multi-pole magnet in which a large number of magnetic poles are peripherally arranged and magnetized. A disk member 86 is fixed to the power transmittable member 61 by rivets 85 and the magnet 83 is fixed to the outer periphery of the disk member 86. That is, the magnet 83 and the disk member 86 are fixed to the drum 51 through the power transmittable member 61 and arranged between the drum 51 and the gear case 32*a* so as to rotate along with the drum 51. Thus, the magnet 83 rotates along with the drum 51 outside the gear case 32*a*, so that the magnetic field created by the magnet 83 is not disturbed by the magnetic field created by the clutch coil 43 of the electromagnetic clutch 37 housed inside the gear case 32*a* and further the magnetized abrasion powders etc. generated from the respective disks 41 and 42 do not adhesive to the magnet 83.

Note that the disk member 86 is made of a metal plate and so in itself generates no magnetic field.

Thus, in the opening/closing system 21, since the magnet 83 is disposed between the drum 51 and the gear case 32*a*, the magnetic field created by the magnet 83 is not disturbed by the magnetic field created by the clutch coil 43 of the electromagnetic clutch 37 housed inside the gear case 32*a*. Additionally, the magnetized abrasion powders etc. generated from the respective disks 41 and 42 are prevented from adhering to the magnet 83. Therefore, any disturbance to the magnetic field created by the magnet 83 is prevented from taking place and hence it is possible to enhance the detection accuracy of the rotation of the drum 51 by the magnetic sensors 84. Additionally, since the magnet 83 is disposed on a side of the gear case 32*a* nearer than the drum 51, the influence on vibrations of the output shaft 36 is reduced and consequently the detection accuracy by the magnetic sensors 84 is enhanced. Further, since the magnetic sensors 84 are arranged outside the gear case 32*a* along with the magnet 83, they are not put under the hot environment such as the interior of the gear case 32*a* made very hot due to the heat etc. generated by the electric motor 26. Thus, it is possible to enhance the detection accuracy of the magnetic sensors 84.

Also, in the opening/closing system 21, the magnet 83 is fixed to the outer periphery of the disk member 86 rotating along with the drum 51. Therefore, the noise generated by the reduction gear mechanism 33 is blocked by the disk member 86, and the noise level in the cabin of the vehicle 11 provided with the opening/closing system 21 is can be reduced.

Additionally, in the opening/closing system 21, the magnet 83 is positioned by fixing the disk member 86 to the power transmittable member 61, so that the magnet 83 can be positioned easily.

The above-described partition wall 76 extends between the drum 51 and the disk member 86 and forms a labyrinth seal along with the disk member 86. In this case, a step section 87 recessed toward the drum 51 is provided to the substantially radial and center portion of the disk member 86. Therefore, the gap between the partition wall 76 and the disk member 86 is slightly reduced by the step section 87 to form the labyrinth seal.

Thus, in the opening/closing system 21, the partition wall 76 forms the labyrinth seal along with the disk member 86, so that the waterproof effect on the opening/closing system 21 is enhanced by the partition wall 76.

Meanwhile, Hall devices are used as the two magnetic sensors 84. The magnetic sensors 84 are mounted on a sensor substrate 88 and housed, along with the sensor plate 88, in a sensor accommodating section 91 formed on the case body 45. At this time, the sensor substrate 88 is held by the case body 45 at the sensor accommodating section 91. Namely, the respective magnetic sensors 84 are held by the case body 45 at the sensor accommodating section 91 through the sensor substrate 88, thereby being positioned so as to oppose the magnet 83. The cover 46 is provided with a falling-off section 92 closing the sensor accommodating section 91. Therefore, when the cover 46 is attached to the case body 45, the sensor accommodating section 91 is closed by the falling-off section 92. For this reason, the sensor substrate 88, namely, the magnetic sensor 84 is prevented from coming away from the sensor accommodating section 91 by the falling-off section 92.

As described above, in the opening/closing system 21, the magnetic sensors 84 are held by the case body 45 at the sensor accommodating section 91, thereby being positioned. Accordingly, the magnetic sensors 84 can easily be positioned with respect to the magnet 83.

Additionally, in the opening/closing system 21, the magnetic sensors 84 are prevented from coming away from the case body 45 by the falling-off section 92 provided to the cover 46, so that the magnetic sensors 84 can be easily attached thereto.

The respective magnetic sensors 84 housed in the sensor accommodating section 91 are peripherally arranged so as to displace only predetermined angles with respect to the magnet 83, whereby phases of detection signals generated by the same magnetic pole are displaced by 90 degrees. With this arrangement, when the drive unit 28 is operated and the magnet 83 rotates along with the drum 51, the magnetic sensors 84 output the detection signals, namely, pulse signals each having a period that depends on the rotation of the drum 51 in response to the change in the magnet poles of the magnet 83 opposing thereto. That is, the magnetic sensors 84 detect the rotation of the drum 51 from the change in the magnetic field of the magnet 83.

The detection signals of the magnetic sensors 84 are inputted to the control unit through sensor lines 93. The control unit can recognize the current position of the sliding door 12 by integrating each of the pulse signals outputted from the magnetic sensors 84 from the time when the sliding door 12 is in the fully closed position, and can also recognize the moving speed of the drum 51, namely, that of the sliding door 12 from the period of each of the pulse signals of the magnetic sensors 84. Additionally, the control unit can recognize the rotating direction of the drum 51, namely, the moving direction of the sliding door 12 from outputting order of the pulse signals of the respective magnetic sensors 84.

Also, the control unit controls the operation of the electric motor 26 on the basis of the opening and closing position and the moving speed of the sliding door 12. Such control includes, for example, so-called slow stop control in which the moving speed of the sliding door 12 is reduced near the fully closed position thereof, and so-called insertion prevention control in which when the period of the pulse signal is prolonged beyond a predetermined value, namely, when the moving speed of the sliding door 12 reduced below a predetermined level, the insertion is detected and the sliding door 12 is stopped and/or moved reversely.

Figure 7:
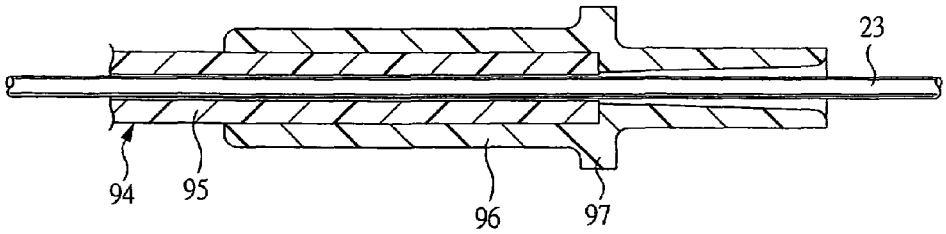
FIG. 7 is a sectional view showing an end section of an outer casing.

FIG. 7 is a sectional view showing an end section of an outer casing, wherein the cables 23 between the reversing pulleys 24 and 25 and the case body 45 are inserted into an outer casing 94 used as a tensile force applying member made of a resin material. The outer casing 94 includes: an outer tube 95 formed into a tube; and a sliding cap 96 attached to an end portion thereof, wherein one end thereof is fixed to the reversing pulleys 24 and 25 and the other end is inserted into the interior of the guide section 54 from the cable insertion hole 56. The one end of the outer casing 94 is movably accommodated axially inside the guide section 54 in such a state that the sliding cap 96 is supported by the guide section 54 at the flange section 97 thereof.

Additionally, a tension spring 98 as a tensile force applying elastic member is provided inside the guide section 54. The tension spring 98 is arranged so as to be coaxial with the cable 23. The cable 23 passes through a center of axis of the tension spring 98. A large diameter fixing section 98*a* greater in diameter than the other portions except for the large diameter fixing section is formed at an end portion of the tension spring 98 located on a side of the drum 51 and without a predetermined range. The large diameter fixing section 98*a* is engaged with a groove 54*a* formed at the end portion of the guide section 54 located on a side of the drum 51. With this arrangement, the end portion of the tension spring 98 is fixed to the case body 45. Therefore, it is unnecessary to provide the case body 45 with a receiving section with which the end portion of the tension spring 98 contacts. Additionally, it is possible to prevent the cable 23 from being guided by the cable guide groove 52 of the drum 51 and being moved along the axis of the output shaft 36 to contact with the tension spring 98 and the receiving section of the case body 45.

In this way, in the opening/closing system 21, since the large diameter fixing section 98*a* of the tension spring 98 is engaged with the groove 54*a* of the case body 45 and is supported by the case body 45, the cable 23 is prevented from contacting with the tension spring 98 and the case body 45 even if the cable 23 is guided by the cable guide groove 52 of the drum 51 and moved along the axis of the output shaft 36.

Meanwhile, the other end of the tension spring 98 abuts the flange section 97 of the sliding cap 96. Thus, the sliding cap 96 is biased by the tension spring 98 so as to be pushed out of the case body 45. Therefore, the outer casing 94 is warped between the reversing pulleys 24 and 25 and the actuator unit 22 by the resilient force of the tension spring 98 used as a spring member, whereby each of the cables 23 is accordingly warped between the reversing pulleys 24 and 25 and the actuator unit 22. In other words, a moving route of each of the cables 23 is detoured by the outer casing 94 between the reversing pulleys 24 and 25 and the actuator unit 22, whereby the tensile force is applied to the cable 23.

Figure 8A:
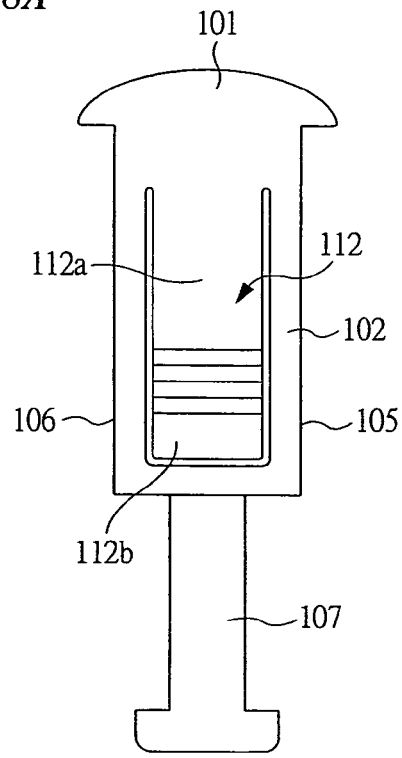
FIG. 8A is an elevation view showing the details of a stopper.
Figure 8B:
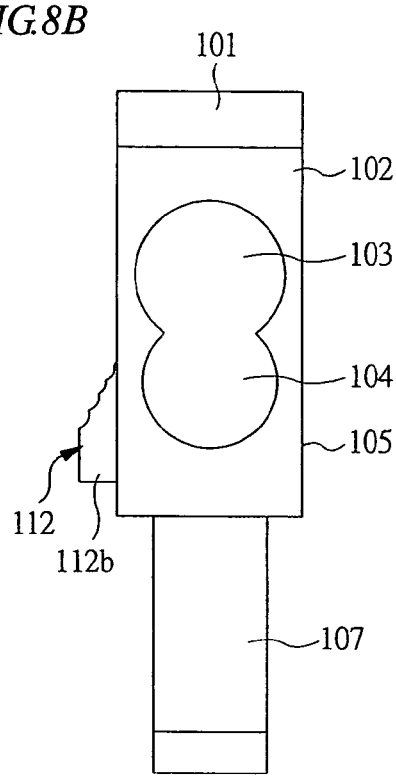
FIG. 8B is a side view showing the details of a stopper.
Figure 8C:
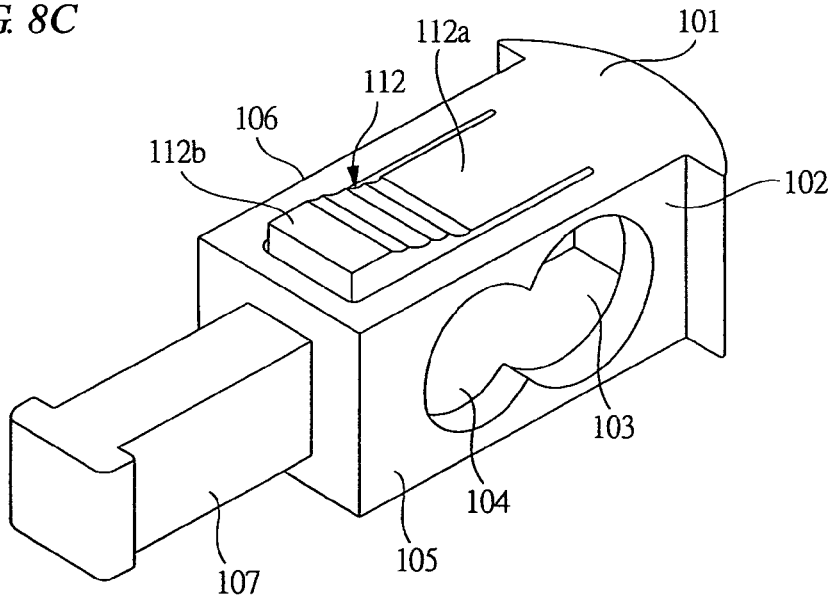
FIG. 8C is a perspective view showing the details of a stopper.
Figure 9A:
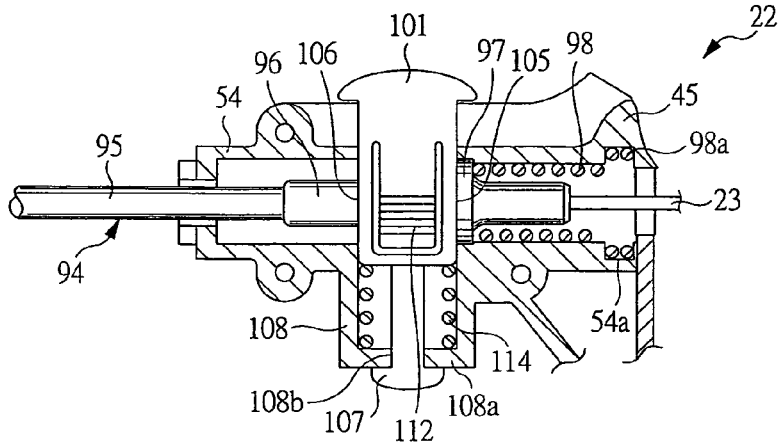
FIG. 9A is an explanatory view showing an operating process of the stopper.
Figure 9B:
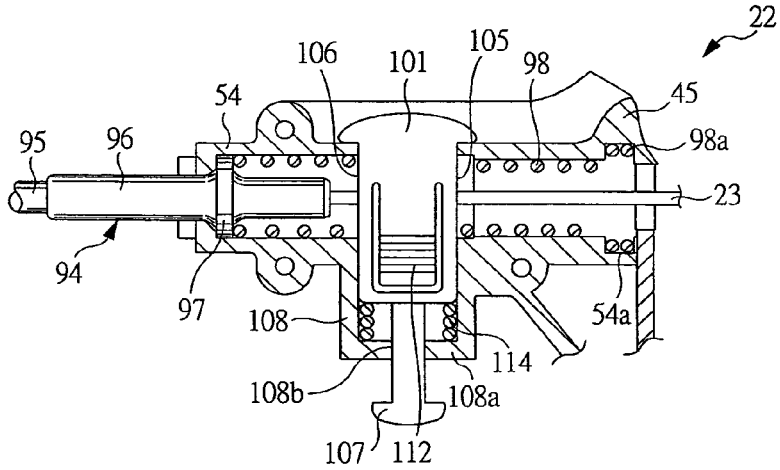
FIG. 9B is an explanatory view showing an operating process of the stopper.
Figure 9C:
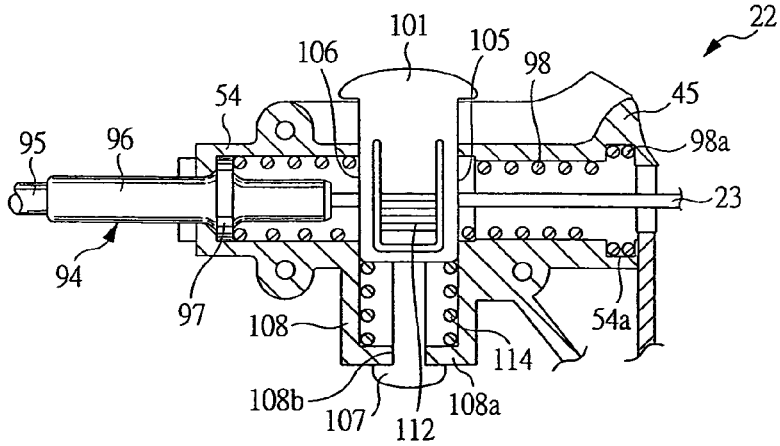
FIG. 9C is an explanatory view showing an operating process of the stopper.
Figure 10A:
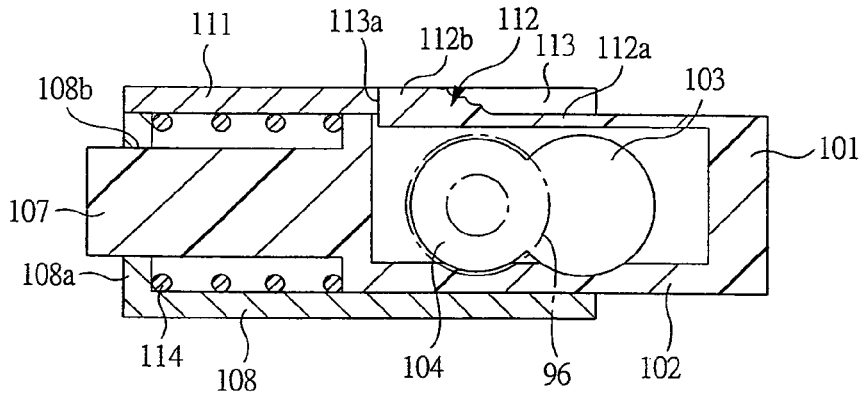
FIG. 10A is a sectional view showing an operating process of the stopper.
Figure 10B:
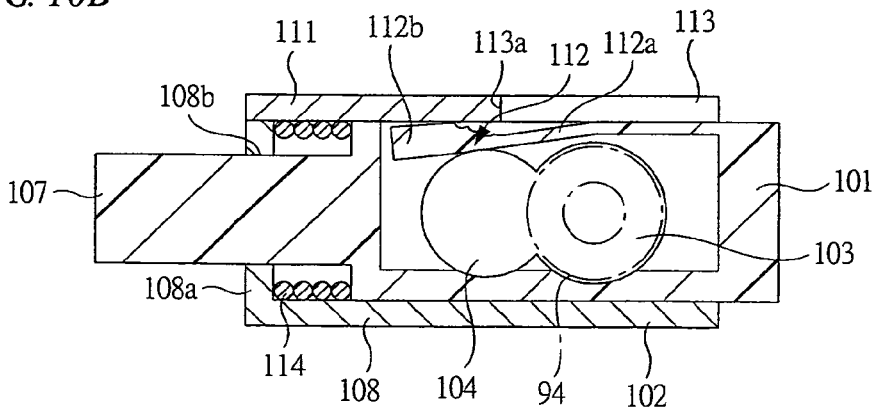
FIG. 10B is a sectional view showing an operating process of the stopper.

FIGS. 8A to 8C are an elevation view, a side view, and a perspective view showing the details of a stopper, respectively, and FIGS. 9A to 9C are explanatory views showing an operating process of the stopper, respectively. FIGS. 10A and 10B are sectional views showing an operating process of the stopper, respectively.

In the above-mentioned opening/closing system 21, the cables 23 need to be loosened to a certain extent when they are linked to the sliding door 12. For this purpose, the opening/closing system 21 is provided with stoppers 101 that temporarily hold the tension spring 98 in a compressed state to release the tensile forces of the cables 23.

As shown in FIGS. 8A to 8C, each of the stoppers 101 has a substantially rectangular base section 102, and a flange passage hole 103 and a cable passage hole 104 are transversally bored through the base section 102. The passage holes 103 and 104 partly overlap with each other to form a single through hole. A temporary holding surface 105 is formed at an opening end of the cable passage hole 104 located on a side of the drum 51, a restriction surface 106 is formed at an opening end of the cable passage hole 104 located on a side of the cable passage hole 56, and further a spring guide section 107 axially projecting is formed an axial end portion of the base portion 102. Note that although the illustrated stopper 101 corresponds to the cable 23 extending on the vehicle-rear side from the drum 51, the stopper 101 that corresponds to the cable 23 extending forward the vehicle-front side from the drum 51 is disposed to have the same shape in which a function of the temporary holding surface 105 and the restriction surface 106 is reversed.

Meanwhile, as shown in FIGS. 9A through 9C, the case body 45 is provided with stopper accommodating sections 108. The stoppers 101 are housed in the respective stopper accommodating sections 108 so as to be axially movable. The axial direction of each of the stopper accommodating sections 108 is perpendicular to an axial direction of the guide section 54, whereas the respective passage holes 103 and 104 bored through the stoppers 101 are in parallel with the axial direction of the guide section 54. Each of the stoppers 101 is axially movable in the stopper accommodating section 108 between a first position where the cable passage hole 104 is coaxial with the cable 23 and a second position where the flange passage hole 103 is coaxial with the cable 23. The spring guide section 107 projects externally from a through hole 108*b* formed at the end portion 108*a* of the stopper accommodating section 108. Note that a guide closing section 111 is integrally provided to the cover 46 so that the stopper accommodating section 108 and the guide section 54 can be closed by the guide closing section 111.

The base section 102 is additionally provided, on a side located close to the guide closing section 111, with a positioning pawl 112. The positioning pawl 112 has: an elastically deformable leaf spring section 112*a* extending toward the interior of the base section 102; and a pawl section 112*b* formed at a tip of the leaf spring section 112*a*. In contrast, the guide closing section 111 constituting the housing case 47 is provided with a positioning groove 113 directed to an axial direction of the stopper 101, and an end portion of the positioning groove 113 is provided with a positioning section 113*a* that can be engaged with the pawl section 112*b*. When the stopper 101 is in the first position, the pawl section 11 2*b* is engaged with the positioning section 11 3*a* so that the stopper 101 is restricted for movement and held to the first position.

The housing case 47 is further provided with a backup spring 114 operating as a stopper biasing resilient member and disposed between the stopper 101 and the end portion 108*a* of the stopper accommodating section 108. The backup spring 114 is a compression coil spring. The stopper 101 is biased to move from the second position to the first position by the resilient force of the backup spring 114.

Now, the operation of the stopper 101 will be described based on FIGS. 9A through 9C and FIGS. 10A and 10B.

Firstly, before each of the cables 23 is linked to the sliding door 12, as shown in FIG. 9A, the stopper 101 is held at the first position and the flange section 97 of the sliding cap 96 is held in a state where it abuts the temporary holding surface 105. Thus, the tension spring 98 becomes compressed, and the cable 23 is loosened sufficiently so that it can be easily linked to the sliding door 12. In other words, in this case, the first position is a position where the tension spring 98 becomes temporarily in a resiliently deformed, namely, in a compressed state. Note that, the inner diameter of the cable passage hole 104 is made smaller than the outer diameter of the flange section 97, so that the flange section 97 can certainly contact with the temporary holding surface 105.

When the tension spring 98 is temporarily held in the compressed state, the outer casing 94 is not pushed out of the case body 45 and the cable 23 is arranged linearly between the case body 45 and the reversing pulleys 24 and 25, whereby the loosening thereof occurs. Thus, the cable 23 can be easily linked to the sliding door 12 and the efficiency on the operation of assembling the opening/closing system 21 can be improved.

Also, when the stopper 101 is in the first position, namely, the temporary holding position, as shown in FIG. 10A, the pawl section 112*b* of the positioning pawl 112 is engaged with the positioning section 113*a*. Therefore, the stopper 101 is held at the temporary holding position even if the opening/closing system 21 is subjected to impact and/or the stopper 101 is subjected to a pushing force by error. Thus, the tension spring 98 is prevented from coming away from the compressed state.

Thus, since each of the stoppers 101 in the opening/closing system 21 is provided with the positioning pawl 112 having a pawl section 112*b* that is engaged with the positioning section 113*a* provided in the housing case 47, the stopper 101 is held at the temporary holding position, thereby preventing the operation errors.

Next, after the cables 23 are linked to the sliding door 12, each of the stoppers 101 is moved to the second position by an operator, as shown in FIG. 9B. At this time, the pawl section 112*b* is operated by the operator so as to be depressed to the interior of the base section 102 and to come away from engagement with the positioning section 113*a*. When the stopper 101 is moved, the pawl section 112*b* slides along the inner surface of the guide closing section 111, as shown in FIG. 10B. When the stopper 101 is moved to the second position, the axial center of the flange passage hole 107 and that of the flange section 97 overlap with each other, whereby the flange section 97 passes through the flange passage hole 103 and the tension spring 98 is released from the temporarily held state, namely, the compressed state. That is, in this case, the second position is a release position for releasing the tension spring 94 from the compressed state. As a result, the outer casing 94 is biased in a direction along which it is pushed out of the case body 45 due to the resilient force of the tension spring 98 and the cable 23 is applied to tensile force of a predetermined level.

Thereafter, when the stopper 101 is brought to the release position and the compression of the tension spring 98 becomes released, the stopper 101 is pushed by the backup spring 114 and automatically moves to the first position, as shown in FIG. 9C. More specifically, when the stopper 101 comes to the second position, as shown in FIG. 9B, the backup spring 114 is compressed between the stopper 101 and the end portion 108*a* of the stopper accommodating section 108 to apply its resilient force to the stopper 101 and so the stopper 101 is biased by the resilient force to move to the first position. If the stopper is returned to the first position, the pawl section 112*b* of the positioning pawl 112 is engaged with the positioning section 113*a* once again, whereby the movement of the stopper 101 is restricted.

When the stopper 101 is returned to the first position, the axis center of the cable passage hole 104 and that of the flange section 97 overlap with each other, so that the movement range of the flange section 97 is restricted to a span between the end surface 55 of the guide section 54 and the restriction surface 106. That is, the flange section 97 whose diameter is greater than the inner diameter of the cable passage hole 104 cannot move beyond the stopper 101. Therefore, when the stopper 101 is moved largely to the side of the drum 51, it comes in contact with the restriction surface 106 and the movement of the stopper 101 is restricted. Thus, in this case, the first position operates as not only the temporary holding position but also the restricting position. When the span of movement of the flange section 97, namely, that of the sliding cap 96 is restricted, the displacement of the tension spring 98 is restricted to a predetermined range that corresponds to the span of movement of the flange section 97. As a result, even if the tension spring 98 having such an extend of displacement that the sufficiently loosing can be caused in the cable 23 is used, the tension spring 98 is prevented from being compressed to an unnecessary extent when the opening/closing system 21 is operated and so the tensile force within an appropriate range can be applied to the cable 23.

Thus, in the opening/closing system 21, the loosing of the cables 23 can be generated while the tension spring 98 is temporarily held in the compressed state by the stopper 101. Therefore, the cables 23 can be easily linked to the sliding door 12.

In the opening/closing system 21, when each of the tension springs 98 is released from the compressed state, the extent of displacement of the tension spring 98 is restricted within the predetermined range by the stopper 101. Therefore, even if the tension spring 98 having such an extent of displacement that the sufficiently loosing of the cable 23 can be generated is used, the cable 23 is not loosened to the unnecessary extent while the opening/closing system 21 is operated. Therefore, the cables 23 are subjected to the appropriate tensile force while the opening/closing system 21 is operated, so that the sliding door 12 can be opened and closed smoothly.

Additionally, in the opening/closing system 21, the backup spring 114 is provided between each of the stoppers 101 and the case body 45. Therefore, when the stopper 101 is pushed to the release position, it is automatically returned to the restricting position by the resilient force of the backup spring 114 and so the stopper 101 can be easily operated.

Needless to say, the present invention is not limited to the above-described embodiment and can be variously modified and altered without departing from the gist thereof. For example, although the opening/closing member in the above-described embodiment is the sliding door, the present invention is not limited to the sliding door and may be a back door, a sunroof, or the like.

Also, although the tension spring 98 is used as a tensile force applying elastic member in the above-described embodiment, the present invention is not limited thereto and may use any other elastic members that can bias the respective outer casings 94.

Further in the above-described embodiment, the tension spring 98 serving as a tensile force applying elastic member is used to generate a tensile force in the cables 23 by warping the outer casings 94 serving as a tension force applying member that covers the cables 23. However, the present invention is not limited thereto and the tension pulley around which the cable 23 is wound may be used as the tension force applying member. Then, the tension pulley is biased by the tensile force applying elastic member to elongate a pathway of the cable 23.

Further in the above-mentioned embodiment, the drum 51 is used as the output member and linked to the opening/closing member through the cable 23. However, the present invention is not limited thereto and, for example, an arm fixed to the output shaft 36 may be used as the output member and linked to the opening/closing member.

Additionally, although the Hall device is used as the magnetic sensor 84 in the above-described embodiment, the present invention is not limited thereto and any other magnetic sensor that can detect the change in the magnetic field of the magnet 83 in accordance with the rotation of the drum 51 may be used.

Finally, although the magnet 83 is fixed to the power transmittable member 61 through the disk member 86 in the above-described embodiment, the present invention is not limited thereto and the disk member 86 may be fixed to the output shaft 36 or the drum 51. Still alternatively, the magnet 83 may be directly fixed to the output shaft 36 or the drum 51 without using the disk member 86.

What is claim is:

1. An opening/closing system for vehicle, which automatically opens and closes an opening/closing member provided to the vehicle, the system comprising:

a drive unit having a drive source and a reduction gear mechanism accommodated in a gear case, an output shaft for outputting a rotation of said drive source projecting from said gear case;

a rotatable output member fixed to a portion of said output shaft projecting from said gear case and linked to said opening/closing member, and outputting power of said drive unit to said opening/closing member, a cable guide groove being formed in an outer peripheral surface of said output member;

an electromagnetic clutch covered by said gear case and a clutch cover, and intermitting power transmission between said reduction gear mechanism and said output shaft;

a case body provided with an output member accommodating section that covers said outer peripheral surface of said output member, the case body being fixed to said gear case;

a magnet disposed between said gear case and said output member, and rotating along with said output member; and a magnetic sensor disposed at said case body so as to oppose said magnet and detecting a rotation of said output member from a change in a magnetic field created by said magnet, wherein a gap between said outer peripheral surface of said output member and said output member accommodating section is smaller than an outer diameter of a cable wound in said cable guide groove of said output member.

2. The opening/closing system for vehicle according to claim 1, wherein said magnet is fixed to an outer periphery of a disk member rotating along with said output member.

3. The opening/closing system for vehicle according to claim 2, wherein said output member is fixed to said output shaft through a power transmittable member and said disk member is fixed to said power transmittable member.

4. The opening/closing system for vehicle according to claim 2, further comprising:

a cover fixed to said case body and closing said output member accommodating section.

5. The opening/closing system for vehicle according to claim 4, wherein said case body is provided with a partition wall extending between said gear case and said output member.

6. The opening/closing system for vehicle according to claim 5, wherein said partition wall extends between said output member and said disk member.

7. The opening/closing system for vehicle according to claim 5, wherein said partition wall forms a labyrinth seal along with said output member.

8. The opening/closing system for vehicle according to claim 5, wherein said partition wall forms a labyrinth seal along with said disk member.

9. The opening/closing system for vehicle according to claim 4, wherein said output shaft is disposed horizontally to said vehicle, and said output member accommodating section is provided with a sloped surface located below said output member and extending to a drainage hole.

10. The opening/closing system for vehicle according to claim 4, wherein said case body is provided with a sensor accommodating section for accommodating said magnetic sensor, and said magnetic sensor is held by said case body in said sensor accommodating section.

11. The opening/closing system for vehicle according to claim 10, wherein said sensor accommodating section is closed by a falling-off section provided to said cover.

12. The opening/closing system for vehicle according to claim 1, further comprising:

a cover fixed to said case body and closing said output member accommodating section.

13. The opening/closing system for vehicle according to claim 12, wherein said case body is provided with a partition wall extending between said gear case and said output member.

14. The opening/closing system for vehicle according to claim 13, wherein said partition wall forms a labyrinth seal along with said output member.

15. The opening/closing system for vehicle according to claim 12, wherein said output shaft is disposed horizontally to said vehicle, and said output member accommodating section is provided with a sloped surface located below said output member and extending to a drainage hole.

16. The opening/closing system for vehicle according to claim 12, wherein said case body is provided with a sensor accommodating section for accommodating said magnetic sensor, and said magnetic sensor is held by said case body in said sensor accommodating section.

17. The opening/closing system for vehicle according to claim 16, wherein said sensor accommodating section is closed by a falling-off section provided to said cover.

* * * * *